US012241341B2

(12) United States Patent
Ghosh et al.

(10) Patent No.: US 12,241,341 B2
(45) Date of Patent: Mar. 4, 2025

(54) DETONATION MODULE

(71) Applicant: Schlumberger Technology Corporation, Sugar Land, TX (US)

(72) Inventors: Indranil Ghosh, Shanghai (CN); Anjali Vijay Dhobale, Houston, TX (US); Richard Lee Warns, Sugar Land, TX (US); Juan Carlos Luna Diaz, Rosharon, TX (US); Andreas Hendrawinata, Missouri City, TX (US); Tommy Nguyen, Pearland, TX (US); Sonia Ried James, Friendswood, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/360,364

(22) Filed: Jul. 27, 2023

(65) Prior Publication Data

US 2024/0133275 A1 Apr. 25, 2024
US 2024/0229617 A9 Jul. 11, 2024

Related U.S. Application Data

(60) Provisional application No. 63/369,536, filed on Jul. 27, 2022.

(51) Int. Cl.

| | |
|---|---|
| ***E21B 43/117*** | (2006.01) |
| ***E21B 43/11*** | (2006.01) |
| ***E21B 43/114*** | (2006.01) |
| ***E21B 43/116*** | (2006.01) |
| ***E21B 43/1185*** | (2006.01) |

(Continued)

(52) U.S. Cl.

CPC ..... *E21B 43/117* (2013.01); *E21B 43/11* (2013.01); *E21B 43/114* (2013.01); *E21B 43/116* (2013.01); *E21B 43/1185* (2013.01); *E21B 43/119* (2013.01); *F42D 1/05* (2013.01)

(58) Field of Classification Search

CPC ..... E21B 43/117; E21B 43/11; E21B 43/114; E21B 43/116; E21B 43/1185; E21B 43/119; F42D 1/05

See application file for complete search history.

(56) References Cited

U.S. PATENT DOCUMENTS

| | | | |
|---|---|---|---|
| 5,503,077 | A | 4/1996 | Motley |
| 8,066,083 | B2 | 11/2011 | Hales |
| 9,080,433 | B2 | 7/2015 | Lanclos |

(Continued)

OTHER PUBLICATIONS

International Search Report and Written Opinion issued in International Patent application PCT/US2023/028811 dated Nov. 15, 2023, 11 pages.

(Continued)

*Primary Examiner* — Yong-Suk (Philip) Ro
(74) *Attorney, Agent, or Firm* — Rushi C. Sukhavasi

(57) ABSTRACT

A detonation module for a perforation tool includes a detonator, a switch circuit disposed in a fluid-sealed housing and electrically coupled to the detonator, a shielding circuit coupled to the switch circuit, an annular electrical contact electrically coupled to the switch circuit, and an annular, electrically conductive, compressive member to form a compressive electrical connection with an end of a perforation unit.

20 Claims, 11 Drawing Sheets

(51) Int. Cl.
*E21B 43/119* (2006.01)
*F42D 1/05* (2006.01)

(56) References Cited

U.S. PATENT DOCUMENTS

| | | | | |
|---|---|---|---|---|
| 9,291,040 | B1 | 3/2016 | Hardesty | |
| 10,030,487 | B2 | 7/2018 | Hardesty | |
| 10,472,938 | B2 | 11/2019 | Parks | |
| 10,767,453 | B2 | 9/2020 | Phelps | |
| 10,781,675 | B2 | 9/2020 | Von Kaenel | |
| 10,858,919 | B2 | 12/2020 | Anthony | |
| 11,047,216 | B2 | 6/2021 | Hardesty | |
| 11,078,763 | B2 | 8/2021 | Anthony | |
| 11,293,271 | B1 | 4/2022 | Hoelscher | |
| 11,293,736 | B2 | 4/2022 | Eitschberger | |
| 11,391,127 | B1 | 7/2022 | Hoelscher | |
| 11,499,401 | B2 | 11/2022 | Eitschberger | |
| 11,512,565 | B2 | 11/2022 | Bryant | |
| 11,619,118 | B2 | 4/2023 | Hardesty | |
| 11,649,684 | B2 | 5/2023 | Garg | |
| 11,674,371 | B1 | 6/2023 | Bradley | |
| 11,675,370 | B2 | 6/2023 | Colijn | |
| 11,697,980 | B2 * | 7/2023 | Goyeneche | F42B 3/02 175/4.57 |
| 11,713,625 | B2 | 8/2023 | Eitschberger | |
| 11,732,556 | B2 | 8/2023 | Eitschberger | |
| 11,898,425 | B2 | 2/2024 | Anthony | |
| 11,920,442 | B2 | 3/2024 | Hardesty | |
| 11,959,367 | B2 | 4/2024 | Bradley | |
| 12,006,802 | B2 | 6/2024 | Badii | |
| 2012/0247771 | A1 * | 10/2012 | Black | E21B 43/1185 166/55 |
| 2013/0014990 | A1 | 1/2013 | Barton | |
| 2019/0292887 | A1 | 9/2019 | Austin, II et al. | |
| 2020/0256166 | A1 | 8/2020 | Knight | |
| 2021/0317728 | A1 | 10/2021 | Preiss et al. | |
| 2021/0341265 | A1 | 11/2021 | Goodman | |
| 2021/0355794 | A1 | 11/2021 | Sokolove | |
| 2022/0034206 | A1 | 2/2022 | Bradley et al. | |
| 2022/0163298 | A1 | 5/2022 | Kash | |
| 2022/0403718 | A1 | 12/2022 | Eitschberger | |
| 2023/0203921 | A1 | 6/2023 | Hardesty | |
| 2023/0228174 | A1 | 7/2023 | Davis | |
| 2023/0323739 | A1 | 10/2023 | Eitschberger | |
| 2023/0323759 | A1 | 10/2023 | Eitschberger | |
| 2024/0003200 | A1 | 1/2024 | Knight | |
| 2024/0003230 | A1 | 1/2024 | Eitschberger | |
| 2024/0117717 | A1 | 4/2024 | Shelton | |
| 2024/0133244 | A1 | 4/2024 | Bryant | |
| 2024/0210150 | A1 | 6/2024 | Eitschberger | |
| 2024/0218764 | A1 | 7/2024 | Bradley | |

OTHER PUBLICATIONS

International Search Report and Written Opinion issued in International Patent application PCT/US2024/026746 dated Aug. 13, 2024, 11 pages.

* cited by examiner

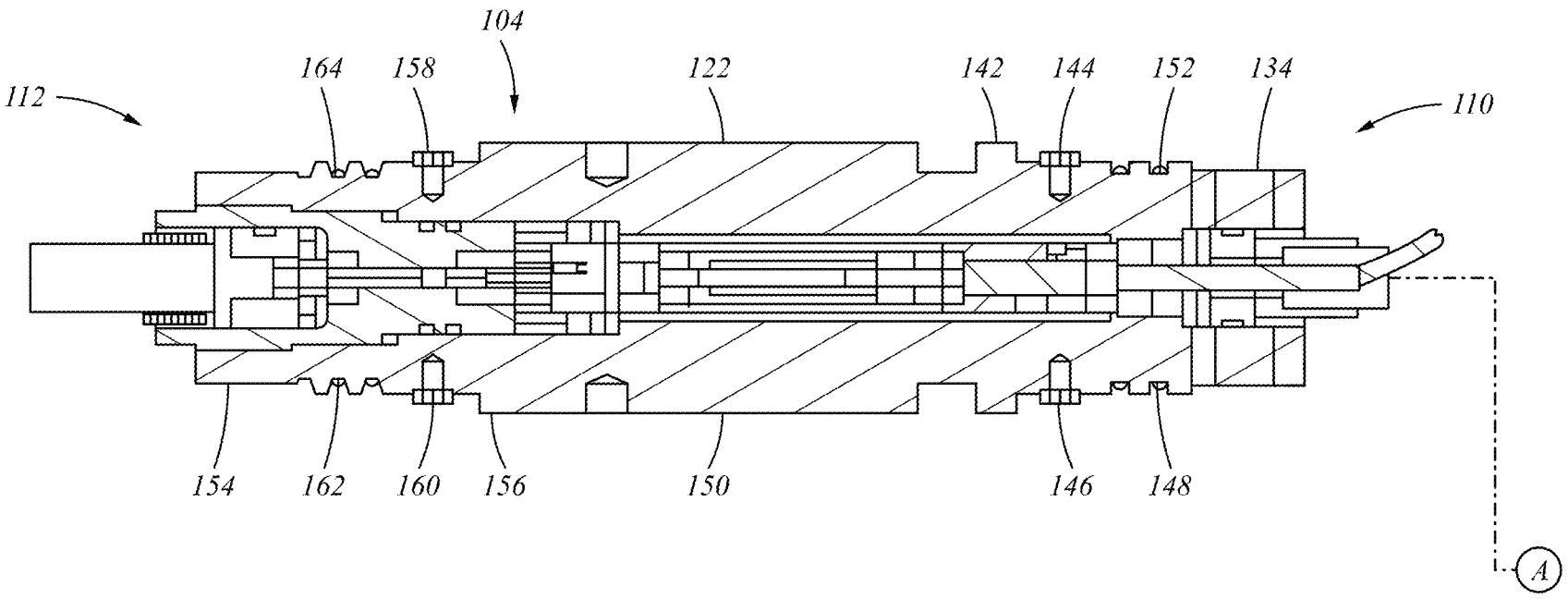
Fig. 1B1

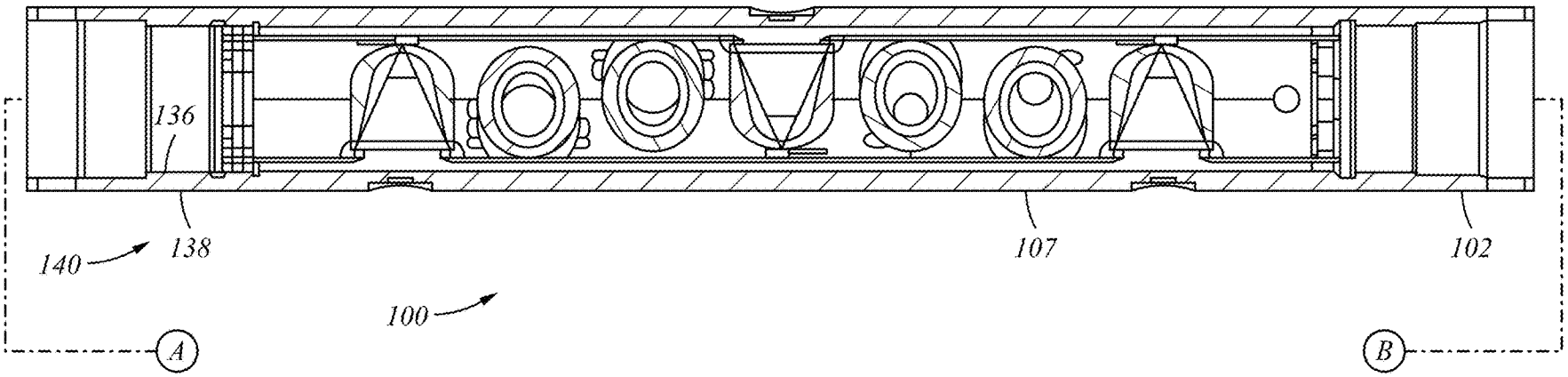
Fig. 1B2

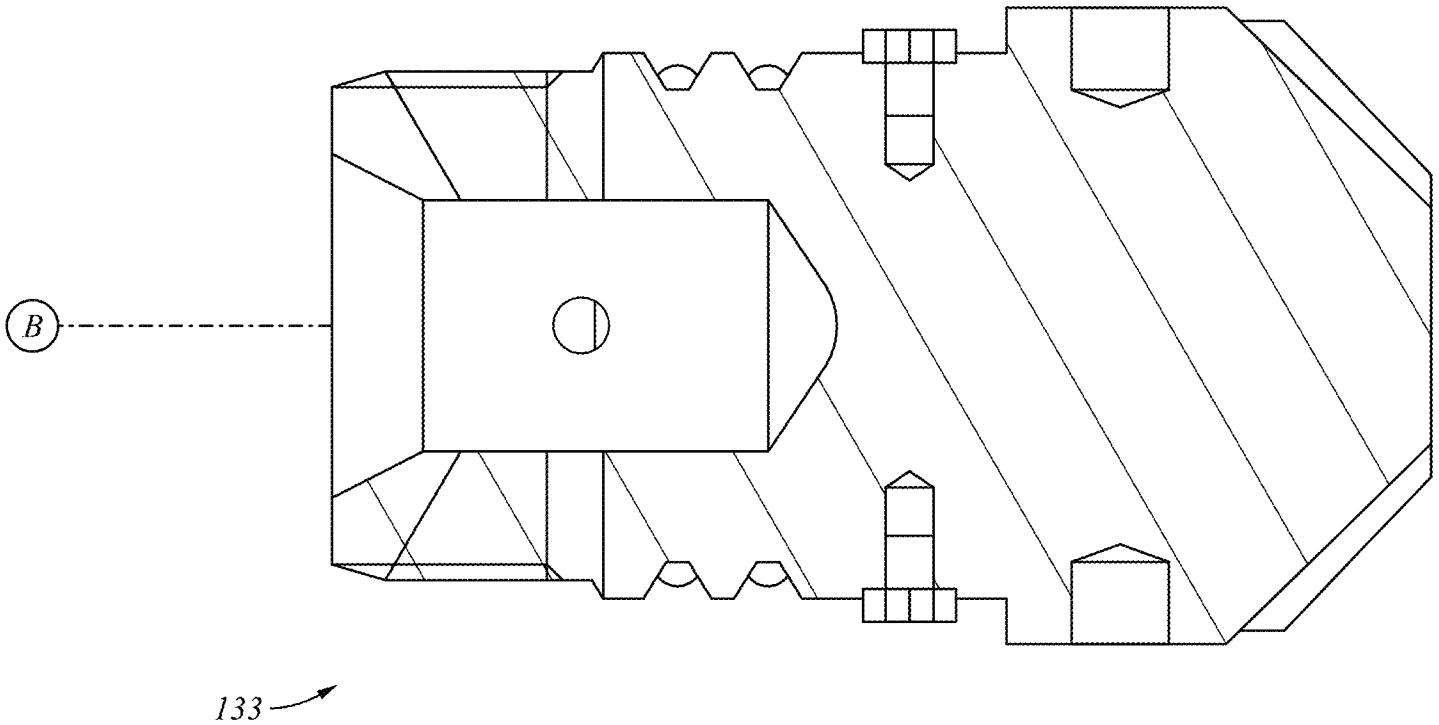
*Fig. 1B3*

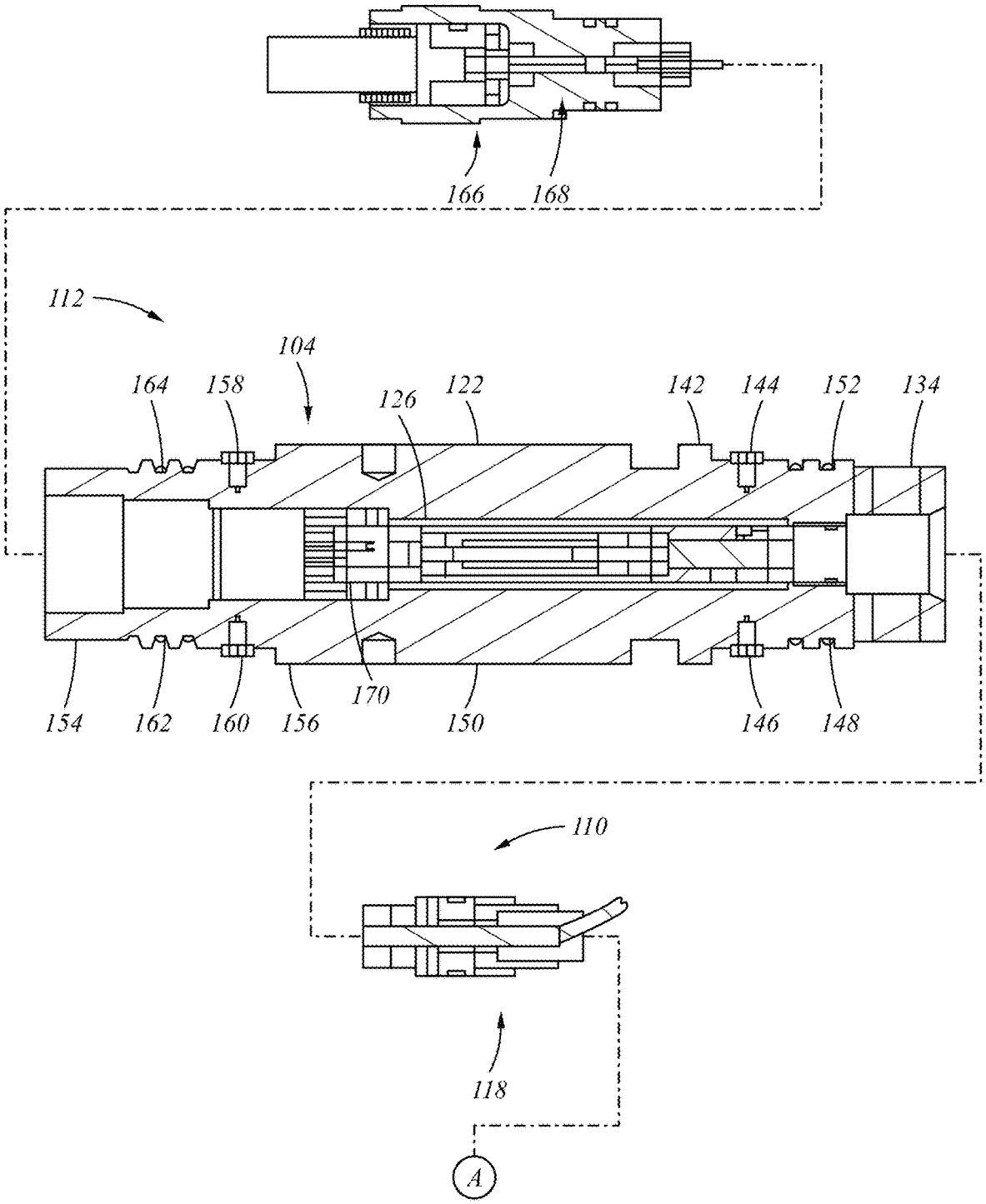
Fig. 1C1

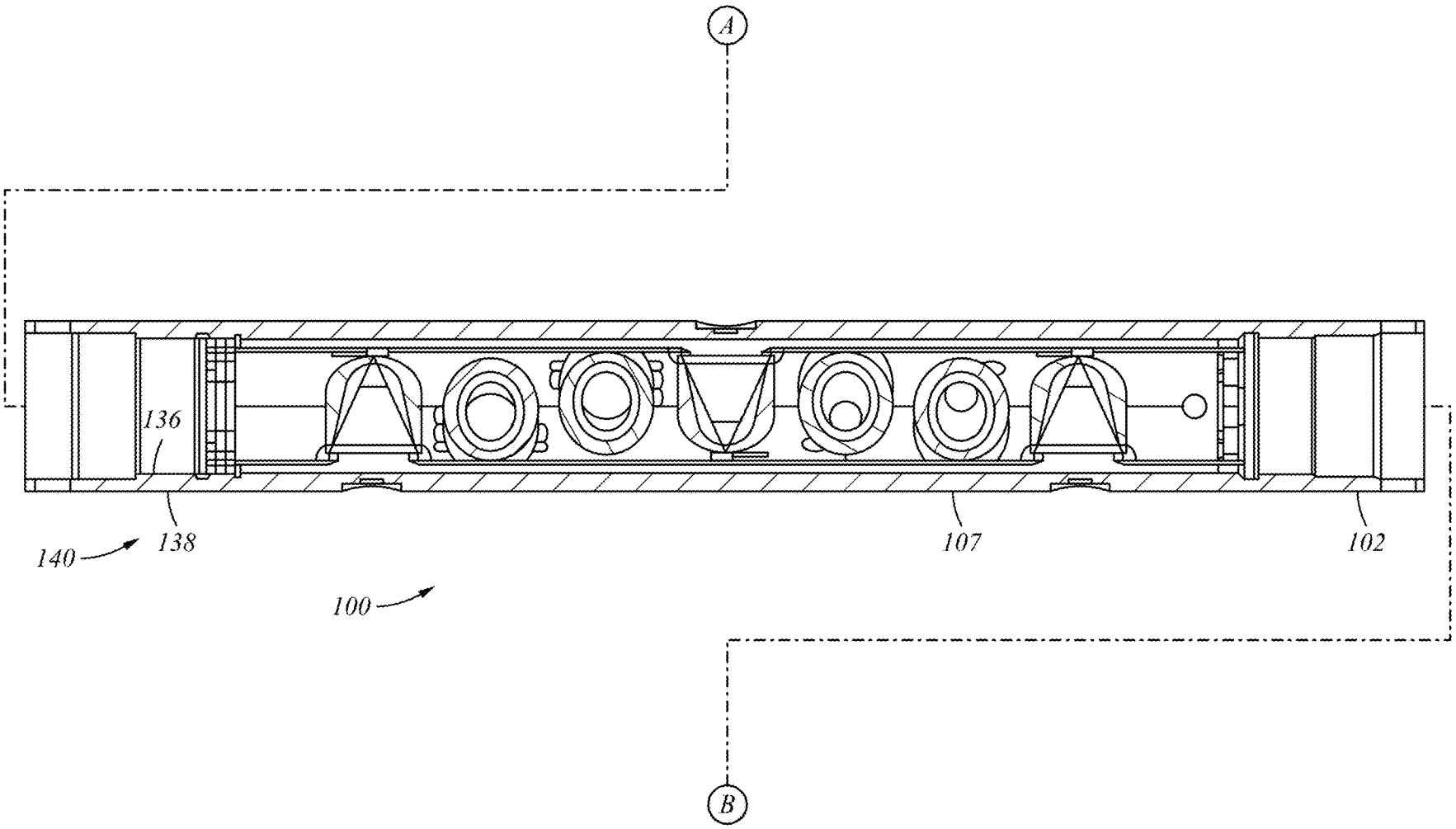
Fig. 1C2

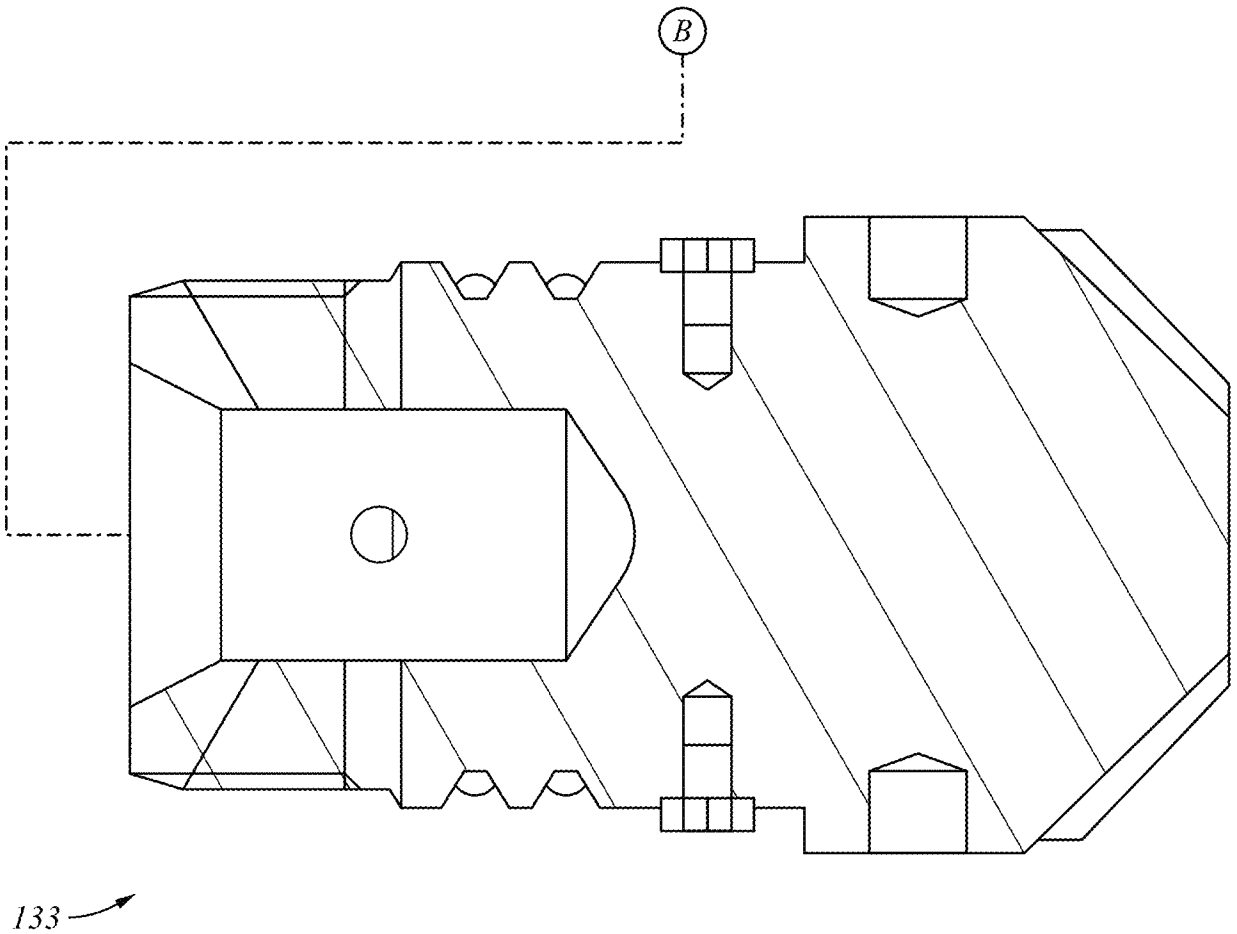
Fig. 1C3

DETONATION MODULE

CROSS-REFERENCE TO RELATED APPLICATIONS

This patent application claims priority to and benefit of U.S. Provisional Patent Application Ser. No. 63/369,536 filed Jul. 27, 2022, which is entirely incorporated herein by reference.

FIELD

This patent application addresses hardware for stimulating hydrocarbon reservoirs. Specifically described herein is hardware for use in perforating wells drilled into geologic formations.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these elements are to be read in this light, and not as an admission of any kind Hydrocarbon reservoirs are commonly stimulated to increase recovery of hydrocarbons. Hydraulic fracturing, where a fluid is pressurized into the reservoir at a pressure above the fracture strength of the reservoir, is commonly practiced. In most fracturing practice, a well is drilled into the formation and a casing formed on the outer wall of the well. The casing is then perforated using explosives to form holes in the casing that can extend a short distance into the formation from the well wall. Perforation creates holes extending from the well wall into the formation.

Perforation tools commonly employ multiple individual perforation "guns" that can be activated to perforate different parts of a well. These guns may be activated at different depths selected to access target areas of the formation. Activation of selected guns is achieved by sending signals to the controller for each gun to activate a switch, which provides electrical connection to the detonator for the selected gun. When the switch is activated, electrical energy can then be coupled to the detonator by a separate firing circuit.

Connection of the circuit and firing the circuit are frequently performed as two separation actions in order to prevent unwanted firing of guns. The "arming" circuit and activity add complexity to the selective firing of perforation guns in a perforation tool. Simplification of the process and architecture of perforation tools, without compromising safety, is needed.

SUMMARY

A summary of certain embodiments described herein is set forth below. It should be understood that these aspects are presented merely to provide the reader with a brief summary of these certain embodiments and that these aspects are not intended to limit the scope of this disclosure.

Embodiments described herein provide a detonation module for a perforation tool, the detonation module comprising a detonator; a switch circuit disposed in a fluid-sealed housing and electrically coupled to the detonator; a shielding circuit coupled to the switch circuit; an annular electrical contact electrically coupled to the switch circuit; and an annular, electrically conductive, compressive member to form a compressive electrical connection with an end of a shaped charge unit.

Other embodiments described herein provide a method of activating a perforation tool, comprising electrically connecting the perforation tool to a detonation module using two annular electrical contacts, at least one of which is compressive; electrically connecting at least one of the annular electrical contacts with a switching circuit in the detonation module; electrically connecting the switching circuit to a detonator and to a shielding circuit in the detonation module, the shielding circuit comprising at least one RF mitigation component; arranging the annular electrical contacts to provide a fluid pathway for transmitting ballistic discharge from the detonator to the perforation tool; and delivering an electrical impulse from the switching circuit to the detonator.

Other embodiments described herein provide a perforation tool, comprising a perforation unit to house shaped charges; and a detonator module coupled to the perforation unit, the detonation module comprising a detonator; a switch circuit disposed in a fluid-sealed housing and electrically coupled to the detonator; a shielding circuit coupled to the switch circuit; an annular electrical contact electrically coupled to the switch circuit; and an annular, electrically conductive, compressive member to form a compressive electrical connection between the annular electrical contact and an end of the perforation unit.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter

BRIEF DESCRIPTION OF THE DRAWINGS

Various aspects of the disclosure may be better understood upon reading the following detailed description and upon references to the drawings, in which:

FIGS. 1B1, 1B2, and 1B3 are a partial disassembly of the cross-sectional view of FIG. 1A.

FIGS. 1C1, 1C2, and 1C3 are a further partial disassembly of the cross-sectional view of FIGS. 1B1, 1B2, and 1B3.

DETAILED DESCRIPTION

Figure 1A:
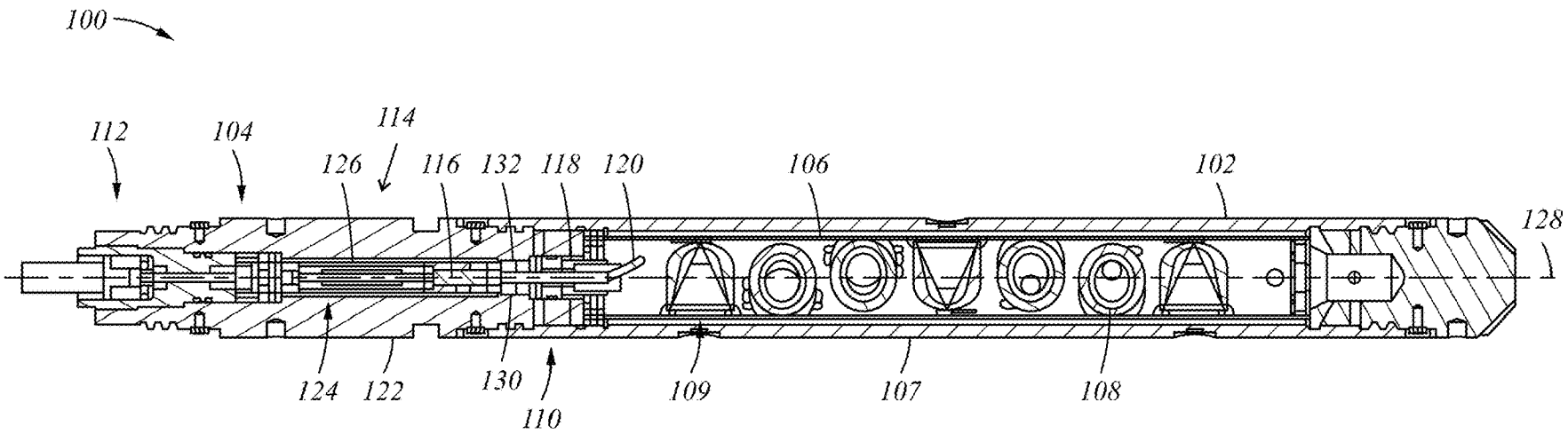
FIG. 1A is a cross-sectional view of a perforation tool according to one embodiment.

A detonation module for a perforation tool is described herein, along with a perforation tool employing the detonation module. The description sets forth details of certain embodiments of the detonation module and perforation tool to facilitate understanding of the structure and operation of the apparatus and methods of using the apparatus, but these details should not be understood as the only way to embody the useful concepts of the apparatus and methods described herein. Variations of the apparatus and methods described herein can be readily ascertained and understood as equally embodying the concepts of the apparatus and methods described herein.

It should be noted that in the development of the embodiments described herein, certain specific choices are made to achieve specific goals, which may vary from one implementation to another. Such choices might be complex to implement but would be routing for those of ordinary skill in this art having the benefit of the description herein. Further, the apparatus and methods described herein can use other components and approaches not described herein. This description should not be read as exclusive of such other components and approaches.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). Also, "the," "a," or "an" are used to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. The word "embodiments" refers to non-limiting examples, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program comprises instructions causing the computer to execute one or more of the operations, or to issue commands to other devices to execute one or more of the operations.

The detonation module described herein automatically, and passively, establishes electrical and ballistic connectivity and conductivity upon assembly of the various modules of the perforation tool, using the described detonation module. The detonation module described herein employs spring connections for secure electrical conductivity along with RF shielding to prevent unwanted firing signals arising from RF noise. The spring connections have open pathways for ballistic continuity.

FIG. 1A is a cross-sectional view of a perforation tool 100, according to one embodiment, in a fully-assembled state. The perforation tool 100 has a perforation unit 102 connected with a detonation module 104. The perforation unit 102 has a charge frame 106 to support one or more shaped charges 108. The shaped charges 108 can all generally be the same or different, but they are usually all the same at least within one perforation unit. The perforation unit 102 has a housing 107 that houses the frame 106 in an interior 109 of the housing 107. The housing 107 has a generally cylindrical shape with a cylindrical inner bore into which the frame 106 is inserted.

The detonation module 104 has a detonation end 110, a feedthrough end 112 opposite from the detonation end 110, and a switch portion 114 between the detonation end 110 and the feedthrough end 112. The detonation end 110 interfaces with the perforation unit 102 to provide ballistic energy to activate the charges 108 of the perforation unit 102. The detonation end 110 has a detonator 116 to initiate application of ballistic energy to activate the charges 108 of the perforation unit 102. The perforation unit 102 has a ballistic transfer unit 118 to engage with the detonation module 104 for ballistic and electrical continuity. The ballistic transfer unit 118 transfers ballistic energy to a ballistic feed 120 that extends along the perforation unit 102 to carry ballistic energy to the charges 108. In this case, the ballistic feed 120 is a detonation cord, but in other cases, the ballistic feed 120 can be a pathway, which may use booster charges to continue ballistic discharge along the perforation tool 102. In this case, the charges 108 extend across the frame 106 from one side to the other, and the charges 108 are phased according to rotational displacements about a longitudinal axis 128 of the tool 100. In other cases, the frame 106 could have a central conduit extending along the longitudinal axis 128, and the charges 108 can be arranged around that central conduit. In such cases booster charges can be disposed within the central conduit, or detonation cord can be routed along the central conduit, to apply ballistic energy to the charges 108 and continue the ballistic discharge along the perforation tool 102.

The detonation module 104 has a housing 122 that houses a switch unit 124 disposed in an interior space 126 of the housing 122. The tool 100 has a generally cylindrical profile, and each unit of the tool 100 also has a generally cylindrical profile. The housing 122 has a generally cylindrical shape and the interior space 126 is a cylindrical bore formed along the longitudinal axis 128 of the tool 100, which substantially coincides with a longitudinal axis of the housing 122 and a longitudinal axis of the perforation unit 102. The switch unit 124 includes passive RF shielding, attenuation, or filtering to prevent unwanted electrical signals reaching the detonator 116. The detonation module 104 has an annular, compressive electrical connector 130 at the detonation end 110 thereof to make electrical connection with an annular contact 132.

FIGS. 1B1, 1B2, 1B3, 1C1, 1C2, and 1C3 show the cross-sectioned perforation tool 100 in progressive disassembly. FIGS. 1B1, 1B2, and 1B3 are a partial disassembly cross-sectional view of the perforation tool 100 of FIG. 1A with the detonation module 104 separated from the perforation unit 102. A cap 133 used for closing an end of the perforation unit 102 is shown in disassembly, as well, for context. The housing 122 has an exterior interface surface 134 at the detonation end 110 of the detonation module 104 that engages with an interior interface surface 136 of the perforation unit 102. The interface surfaces 134 and 136 can be threaded or engaged according to any convenient method. An overlap portion 138 of the housing 107 of the perforation unit 102 extends over the detonation end 110 of the detonation module 104 until the interface surfaces 134 and 136 can be engaged. An end 140 of the housing 107 reaches to a first external shoulder 142 of the housing 122 of the detonation module 104 adjacent to first fastening bores 144 formed in the housing 122 adjacent to the detonation end 110 thereof. When the detonation module 104 is coupled to the perforation unit 102, first fasteners 146 are installed into the first fastening bores 144 to secure the detonation module 104 to the first perforation unit 102. One or more first grooves 148 are provided in an exterior wall 150 of the housing 122 between the first fastening bores 144 and the exterior interface surface 134. Each first groove 148 receives a seal member 152 to seal the interface between the detonation module 104 and the first perforation unit 102.

The housing 122 has a second exterior interface surface 154 at the feedthrough end 112 of the housing 122 to engage with an interior interface surface of another unit, such as another perforation tool (not shown), which can also be threaded or can use any convenient method of engagement. The housing 122 has a second external shoulder 156 near the feedthrough end 112. An overlap portion of another unit can extend over the feedthrough end 112 to reach the second external shoulder 156, and can be secured by second fasteners 158 disposed in second fastening bores 160 adjacent to the second external shoulder 156. One or more second grooves 162 are provided in the exterior wall 150 of the housing 122 between the second exterior interface surface 154 and the second fastening bores 160 to receive seal members 164 to seal the interface between the detonation module 104 and another tool.

FIGS. 1C1, 1C2, and 1C3 are a further partial disassembly cross-sectional view of the perforation tool 100 showing separation of internal components from the housing 122. The ballistic transfer unit 118 is separated from the housing 122 to the right, and a feedthrough unit 166 is separated from the housing 122 to the left. To assemble the detonation module 104, the ballistic transfer unit 118 is inserted into the housing 122 at the detonation end 110 of the detonation module 104, and the feedthrough unit 166 is inserted into the housing 122 at the feedthrough end 112. The ballistic transfer unit 118 is press-fit into the housing 122, while the feedthrough unit 166 can be press-fit or threaded into the housing 122. The feedthrough unit 166 has a fitting 168 that engages with the housing 122 and with switch electronics 170 to position the switch electronics 170 within the interior space 126 of the housing.

Figure 2A:
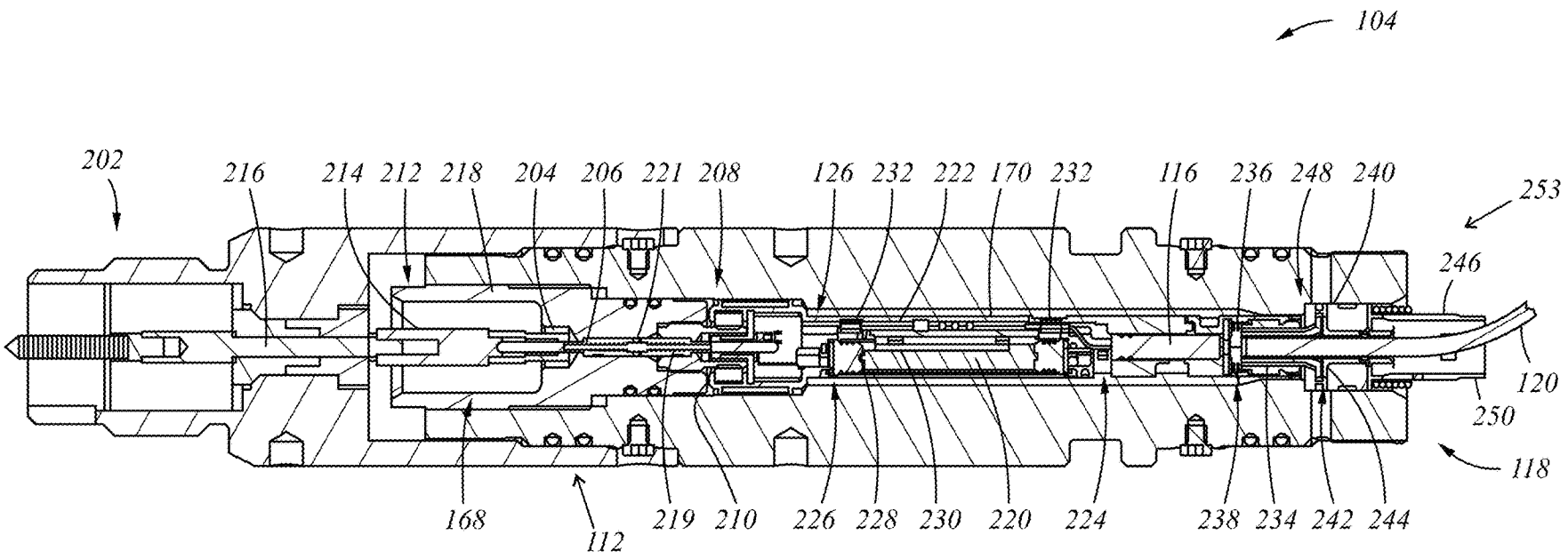
FIG. 2A is a detail view of a detonation module according to one embodiment.

FIG. 2A is a detailed cross-sectional view of the detonation module 104. In this case, the detonation module 104 has an extra feedthrough adapter 202 attached at the feedthrough end 112 of the detonation module 104. The feedthrough adapter 202 can be used to interface the detonation module 104 with another unit.

The fitting 168 has a central bore 204 that accommodates a conductive member 206, which extends substantially from end to end of the fitting 168 to provide electrical connectivity at either end of the fitting 168. At a first end 208 of the fitting, proximate to the switch electronics 170 when assembled, the conductive member 206 engages with a cartridge 210 that houses the switch electronics 170 and provides electrical connection with the switch electronics 170. At a second end 212 of the fitting, opposite from the first end 208, the conductive member 206 emerges into a plug end 214 that can interface electrically with another unit. In this case, a feedthrough member 216 of the feedthrough adapter 202 engages with the conductive member 206.

The fitting 168 has an outer body 218 that, in this case, is conductive, so an insulator 219 is disposed around the conductive member 206 within the central bore 204 of the fitting 168. The insulator 219 is, in this case, overmolded onto the conductive member 206, but an insulator can be used according to any convenient design. At a midpoint of the insulator 219, a seal member 221 is disposed around the insulator 219, between the insulator 219 and an inner wall of the central bore 204. The seal member 221 seals the central bore 204 and secures the conductive member 206 within the central bore 204 by friction with the inner wall.

The switch electronics 170 is located in the interior 126 of the housing 122 between the fitting 168 and the detonator 116. The switch electronics 170 and the detonator 116 are enclosed in the cartridge 210 which extends from the fitting 168 to the ballistic transfer unit 118. The switch electronics 170 includes a switch circuit 220 and a shielding circuit 222. The switch electronics 170 is electrically coupled to the detonator 116 at a first end 224 of the switch electronics 170 and to the connector cartridge 210 at a second end 226 of the switch electronics 170 opposite from the first end 224. The cartridge 210 features an inner casing 228 that encloses the switch circuit 220, which extends in the longitudinal direction of the detonation module 104. The inner casing 228 can be plastic. The cartridge 210 also features a plurality of prongs 230 that support the shielding circuit 222 in a spaced-apart orientation substantially parallel to the switch circuit 220. The shielding circuit 222 generally has capacitive components, such as spark gaps, switches, and capacitors, that absorb and attenuate RF noise in electrical leads electrically connected to the detonator to minimize the opportunity for unwanted electrical impulses to activate the detonator. The switch electronics 170 also includes RF attenuators 232, in this case ferrite beads, disposed on electrical leads connecting to the shielding circuit 222 to enhance attenuation of RF noise. The capacitive components and RF attenuators function as RF mitigators, so that the switch electronics 170 includes a first RF mitigation component and a second RF mitigation component to provide broad shielding against RF noise.

The ballistic transfer unit 118 has a conductive nose 234 that at least partially surrounds an end of the ballistic feed 120. The conductive nose 234 has a generally cylindrical shape with an axial opening 236 at a first end 238 of the conductive nose 234 and a flange 240 at a second end 242 of the conductive nose 234 opposite from the first end 238 in an axial direction of the conductive nose 234. An end of the ballistic feed 120 is disposed within the conductive nose 234 in contact with the first end 238 so the axial opening 236 exposes an end region of the ballistic feed 120 at the first end 238. The flange 240 is captured within an annular capture space 244 of a connection structure 246 of the ballistic transfer unit 118.

The capture space 244 of the connection structure 246 is at a first end 248 of the connection structure 246. The connection structure 246 also has a sleeve 250 at a second end 253 of the connection structure 246 opposite from the first end 248 in an axial direction of the connection structure 246. The sleeve 250 of the connection structure 246 is a cylindrical extension that extends into an end of the charge frame 106 to position the ballistic feed 120 to carry ballistic energy to the charges 108. As noted above, in this case the ballistic feed 120 is disposed at a periphery of the charge frame 106. In cases where the charge frame 106 has a central conduit, with charges arranged around the central conduit and pointing away from the central conduit, and the ballistic feed is the central conduit with booster charges disposed therein (i.e. no detonation cord is used), the connection structure 246 may be omitted.

Figure 2B:
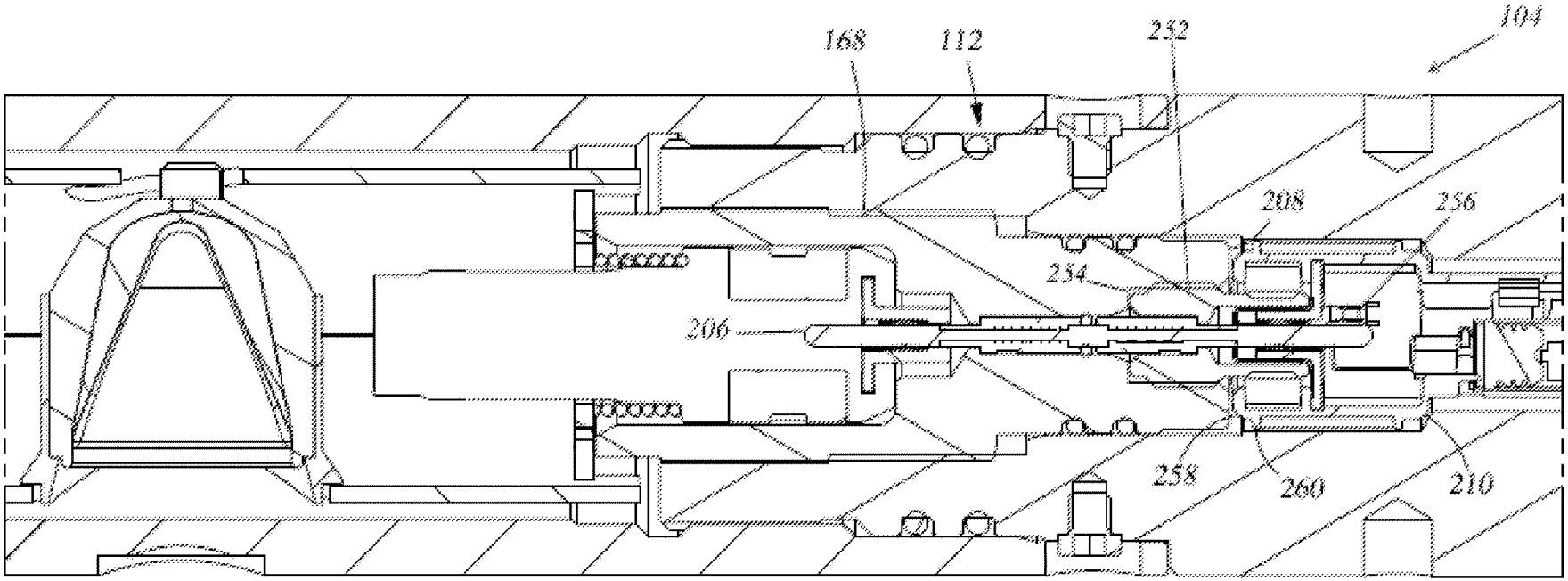
FIG. 2B is a detail view of a portion of the detonation module of FIG. 2A assembled in the perforation tool of FIG. 1A.

FIG. 2B is a close-up cross-sectional view of a portion of the detonation module 104 at the feedthrough end 112 thereof. Here, the feedthrough end 112 of the detonation module 104 is shown engaged with a perforation unit such as the perforation unit 102 at a distal end thereof opposite from the end of the perforation unit 102 engaged with the ballistic transfer unit 118 of the detonator module 104. FIG. 2B illustrates the multi-unit connectivity of the detonator module 104. The fitting 168 engages with the detonation module 104 using a bushing 252. The bushing 252 fits into an annular space 254 defined between the conductive member 206 and the interior wall of the fitting 168 at the second end 208 thereof. The bushing 252 connects with the end of the cartridge 210 and provides a pathway, through a central passage of the bushing 252, for the conductive member 206 to extend into the cartridge 210 and make contact with a wire contact 256 that connects to a wire from the switch electronics 170 (not shown).

The cartridge 210, which abuts the second end 208 of the fitting 168, is in two pieces that divide in a longitudinal direction (meaning that the division between the two pieces extends in a longitudinal direction) and have snaps or clasps (not shown) that hold the two pieces together when assembled. The cartridge 210 has a wide end 258 adjacent to the second end 226 of the switch electronics 170 (FIG. 2A) to facilitate correct installation of the cartridge 210. The wide end 258 of the cartridge 210 has a plurality of stand-offs 260 that, when the cartridge is installed in the housing 122, contact an interior wall of the housing 122 to provide centering and stable positioning of the cartridge 210 within the housing. The stand-offs 260 can also absorb some shock and can help prevent unwanted disconnection of the switch electronics 170. The pieces of the cartridge 210 can be plastic, and can be molded.

Figure 2C:
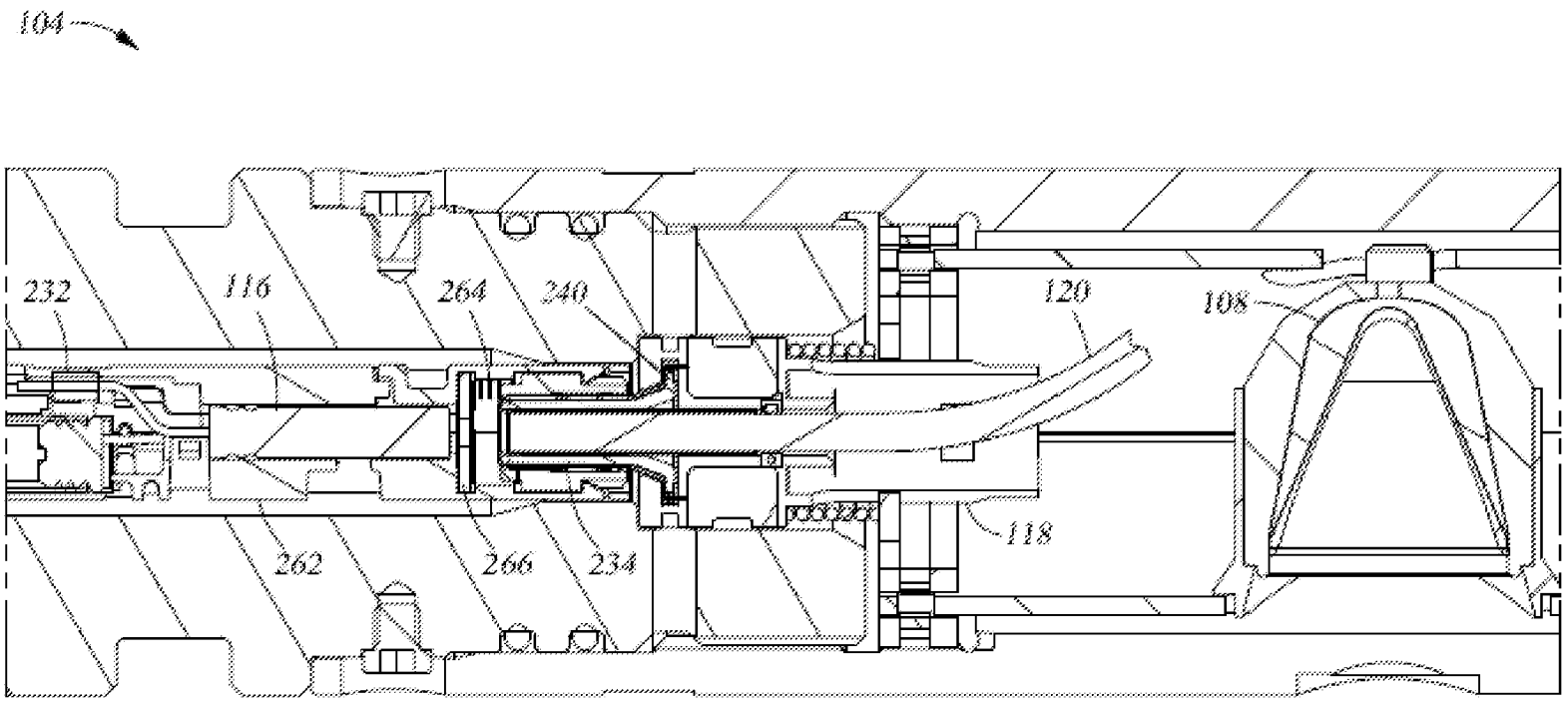
FIG. 2C is a detail view of another portion of the detonation module of FIG. 2A assembled in the perforation tool of FIG. 1A.

FIG. 2C is a close-up cross-sectional view of a portion of the detonation module 104 at the detonation end 110 thereof. As noted above, an RF attenuator 232 is disposed around a wire leading to the detonator 116. The detonator 116 is disposed in a receptacle 262 formed by the two pieces of the cartridge 210. The receptacle 262 positions the detonator 116 in a central location of the cartridge 210, the detonator module 104, and the perforation tool 100, so that ballistic discharge from the detonator 116 can be transmitted to the charges 108.

An annular, electrically conductive, compressive member 264 is disposed between the detonator 116 and the conductive nose 234 of the ballistic transfer unit 118. An annular electrical contact 266 is disposed between the detonator 116 and the compressive member 264 to provide electrical connectivity between the switch electronics 170 and the conductive nose 234, which in turn provides electrical connectivity to the perforation unit 102 through the flange 240.

Figure 2D:
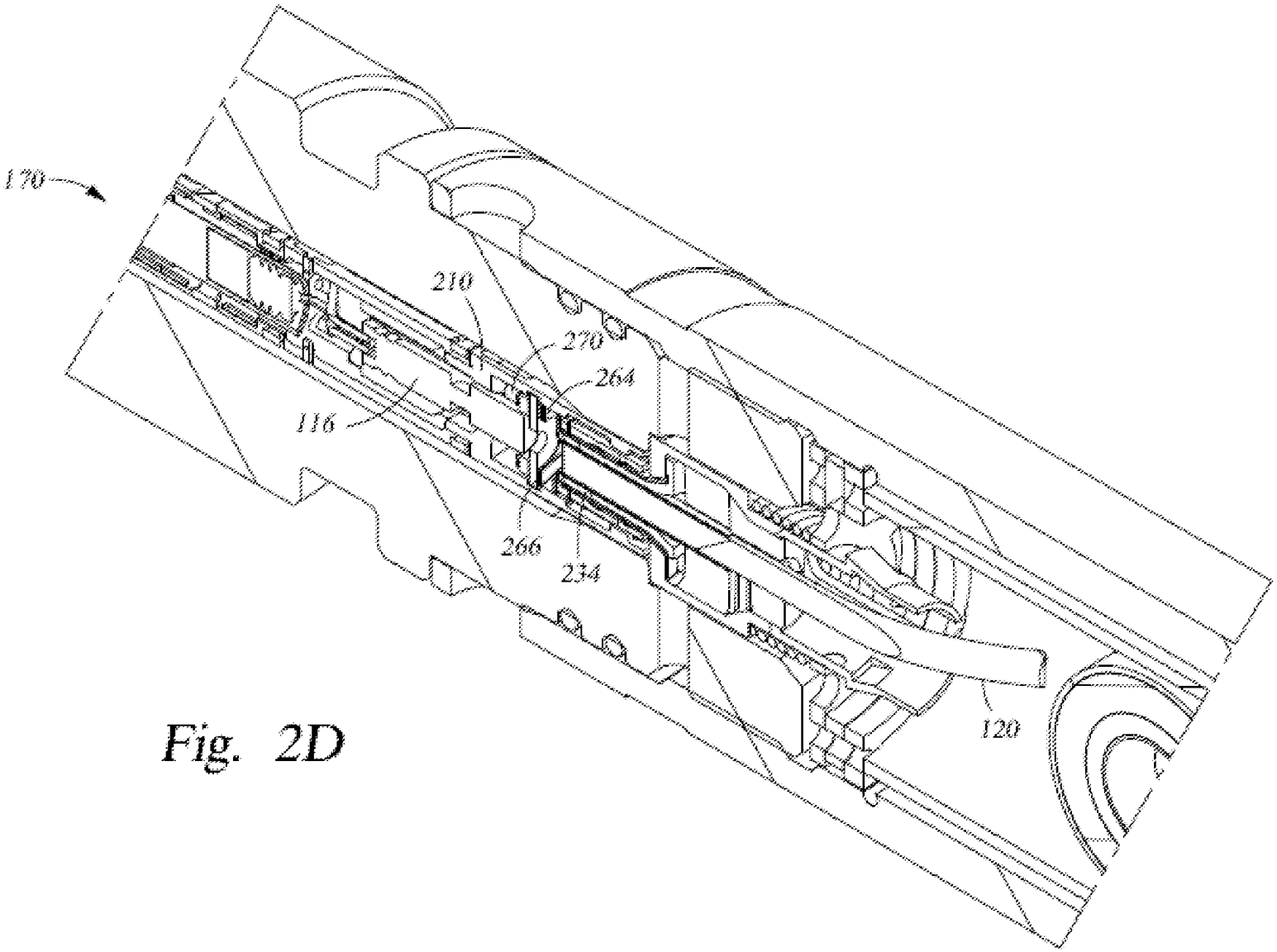
FIG. 2D is an oblique cross-sectional view of a portion of the detonation module of FIG. 2A assembled in the perforation tool of FIG. 1A.

FIG. 2D is an oblique view of the cross-section of FIG. 2C. This view shows the annular electrical contact 266 and the annular conductive compressive member 264 between the conductive nose 234 and the detonator 116. Central openings of the annular members 264 and 266 provide ballistic continuity from the detonator 116 to the ballistic feed 120 while the periphery of the annular members 264 and 266 maintain electrical continuity within the tool 100. Wires 270 are electrically connected to the annular contact 266 and to the switch electronics 170 passing by the detonator 116 within the cartridge 210. The detonator discharge moves through the central openings of the annular contact 266, the annular compressive member 264, and the annular end of the conductive nose 234 to activate the ballistic feed 120, in this case a detonation cord, while electrical connectivity is maintained (prior to detonator discharge) by the peripheral conductive portions of the annular compressive member 264, the annular contact 266, and the annular end of the conductive nose 234.

As described above, certain embodiments of the present disclosure include a detonation module for a perforation tool. The detonation module includes a detonator; a switch circuit disposed in a fluid-sealed housing and electrically coupled to the detonator; a shielding circuit coupled to the switch circuit; an annular electrical contact electrically coupled to the switch circuit; and an annular, electrically conductive, compressive member to form a compressive electrical connection between the annular electrical contact and an end of a perforation unit.

In certain embodiments, the shielding circuit combines a first RF mitigation component and a second RF mitigation component, and the first RF mitigation component is different from the second RF mitigation component. In certain embodiments, the detonator is electrically coupled to the shielding circuit by a wire, and the first RF mitigation component is a ferrite bead disposed around the wire.

In certain embodiments, the annular, electrically conductive compressive member is a wave spring. In certain embodiments, the detonator, the annular, electrical contact, and the annular, electrically conductive, compressive member are substantially coaxial. In certain embodiments, the annular contact and the annular electrically conductive, compressive member together form a fluid pathway to fluidly couple the detonator to ballistic members of a perforation unit when the perforation unit is connected to the detonation module. In certain embodiments, the detonation module also includes a housing that positions the housing of the switch circuit to connect to a feedthrough unit.

In addition, as described above, in certain embodiments of the present disclosure, a method of activating a perforation tool includes electrically connecting a perforation unit to a detonation module using two annular electrical contacts, at least one of which is compressive; electrically connecting at least one of the annular electrical contacts with a switching circuit in the detonation module; and electrically connecting the switching circuit to a detonator and to an shielding circuit in the detonation module, the shielding circuit including at least one RF mitigation component. The method also includes arranging the annular electrical contacts to provide a fluid pathway for transmitting ballistic discharge from the detonator to the perforation unit; and delivering an electrical impulse from the switching circuit to the detonator.

In certain embodiments, the shielding circuit includes a first RF mitigation component and a second RF mitigation component, and the first RF mitigation component is different from the second RF mitigation component. In certain embodiments, the first RF mitigation component is a ferrite bead and the second RF mitigation component is a capacitive component. In certain embodiments, the annular electrical contacts comprise a compressive member. In certain embodiments, the compressive member is a wave spring. In certain embodiments, the switching circuit and the shielding circuit are housed in a fluid-sealed housing located adjacent to the detonator.

In addition, as described above, in certain embodiments of the present disclosure, a perforation tool includes a perforation unit to house shaped charges and a detonator module coupled to the perforation unit. The detonation module includes a detonator, a switching circuit disposed in a fluid-sealed housing and electrically coupled to the detonator, a shielding circuit coupled to the switching circuit, an annular electrical contact electrically coupled to the switching circuit, and an annular, electrically conductive, compressive member to form a compressive electrical connection between the annular electrical contact and end of the perforation unit.

In certain embodiments, the perforation unit includes a ballistic transfer device arranged at the end of the perforation unit, and the end of the perforation unit includes a conductive nose disposed over an end of the ballistic transfer device, the conductive nose having a central opening that exposes the end of the ballistic transfer device. In certain embodiments, the annular, electrically conductive, compressive member is a wave spring, and the annular electrical contact, the wave spring, and the conductive nose together define a fluid pathway from the detonator to the ballistic transfer device and electrically connect the perforation unit with the detonation module. In certain embodiments, the annular electrical contact and the annular electrically conductive, compressive member together form a fluid pathway to fluidly couple the detonator to ballistic members of the perforation unit. In certain embodiments, the shielding circuit includes a capacitive component and a ferrite bead. In certain embodiments, the ferrite bead is disposed around a wire connecting the shielding circuit with the detonator.

While the foregoing is directed to embodiments of the present invention, other and further embodiments of the present disclosure may be devised without departing from the basic scope thereof, and the scope thereof is determined by the claims that follow.

We claim:

1. A detonation module for a perforation tool, the detonation module comprising:

an end configured to receive and couple to a ballistic transfer unit of the perforation tool;

a detonator;

a switch circuit disposed in a fluid-sealed housing and electrically coupled to the detonator;

a shielding circuit coupled to the switch circuit;

an annular electrical contact electrically coupled to the switch circuit; and an annular, electrically conductive, compressive member configured to directly couple to the ballistic transfer unit of the perforation tool and form a compressive electrical connection between the annular electrical contact and the ballistic transfer unit, wherein the annular electrical contact is disposed between the detonator and the annular, electrically conductive, compressive member.

2. The detonation module of claim 1, wherein the shielding circuit combines a first RF mitigation component and a second RF mitigation component, wherein the first RF mitigation component is different from the second RF mitigation component.

3. The detonation module of claim 2, wherein the detonator is electrically coupled to the shielding circuit by a wire, and the first mitigation component is a ferrite bead disposed around the wire.

4. The detonation module of claim 2, wherein the first RF mitigation component is a ferrite bead and the second RF mitigation component is a capacitive component.

5. The detonation module of claim 1, wherein the annular, electrically conductive, compressive member is a wave spring.

6. The detonation module of claim 1, wherein the detonator, the annular electrical contact, and the annular, electrically conductive, compressive member are substantially coaxial.

7. The detonation module of claim 1, wherein a perforation unit is connected to the detonation module, and wherein the annular electrical contact and the annular electrically conductive, compressive member together form a fluid pathway to fluidly couple the detonator to ballistic members of the perforation unit.

8. The detonation module of claim 1, further comprising a housing that positions the housing of the switch circuit to connect to a feedthrough unit.

9. A method of activating a perforation tool, comprising:

electrically connecting a perforation unit to a detonation module using an annular electrical contact and an annular, electrically conductive, compressive member, wherein electrically connecting the perforation unit to the detonation module comprises inserting the ballistic transfer unit of the perforation unit into an end of the detonation module, and wherein the annular, electrically conductive, compressive member is configured to directly couple to the ballistic transfer unit and form a compressive electrical connection between the annular electrical contact and the ballistic transfer unit;

electrically connecting the annular electrical contact with a switching circuit in the detonation module, wherein the annular electrical contact is disposed between the detonator and the annular, electrically conductive, compressive member;

electrically connecting the switching circuit to a detonator and to a shielding circuit in the detonation module, the shielding circuit comprising at least one RF mitigation component;

and delivering an electrical impulse from the switching circuit to the detonator.

10. The method of claim 9, wherein the shielding circuit comprises a first RF mitigation component and a second RF mitigation component different from the first RF mitigation component.

11. The method of claim 9, wherein the first RF mitigation component is a ferrite bead and the second RF mitigation component is a capacitive component.

12. The method of claim 9, wherein the annular electrical contacts comprise a compressive member.

13. The method of claim 12, wherein the compressive member is a wave spring.

14. The method of claim 9, wherein the switching circuit and the shielding circuit are housed in a fluid-sealed housing located adjacent to the detonator.

15. A perforation tool, comprising:

a perforation unit to house shaped charges, the perforation unit comprising a ballistic transfer unit; and a detonator module coupled to the perforation unit, the detonation module comprising:

an end configured to receive and couple to the ballistic transfer unit of the perforation unit;

a detonator;

a switch circuit disposed in a fluid-sealed housing and electrically coupled to the detonator;

a shielding circuit coupled to the switching circuit;

an annular electrical contact electrically coupled to the switching circuit; and an annular, electrically conductive, compressive member configured to directly couple to the ballistic transfer unit of the perforation unit and form a compressive electrical connection between the annular electrical contact and the ballistic transfer unit, wherein the annular electrical contact is disposed between the detonator and the annular, electrically conductive compressive member.

16. The perforation tool of claim 15, wherein the end of the perforation unit comprises a conductive nose disposed over an end of the ballistic transfer unit, the conductive nose having a central opening that exposes the end of the ballistic transfer unit.

17. The perforation tool of claim 16, wherein the annular, electrically conductive, compressive member is a wave spring, and the annular electrical contact, the wave spring, and the conductive nose together define a fluid pathway from the detonator to the ballistic transfer device and electrically connect the perforation unit with the detonation module.

18. The perforation tool of claim 15, wherein the annular electrical contact and the annular electrically conductive, compressive member together form a fluid pathway to fluidly couple the detonator to ballistic members of the perforation unit.

19. The perforation tool of claim 15, wherein the shielding circuit comprises a capacitive component and a ferrite bead.

20. The perforation tool of claim 19, wherein the ferrite bead is disposed around a wire connecting the shielding circuit with the detonator.

* * * * *